US010102964B2

(12) United States Patent
Kim et al.

(10) Patent No.: US 10,102,964 B2
(45) Date of Patent: Oct. 16, 2018

(54) COIL ELECTRONIC COMPONENT AND MANUFACTURING METHOD THEREOF

(71) Applicant: Samsung Electro-Mechanics Co., Ltd., Suwon-si (KR)

(72) Inventors: Jin-Soo Kim, Seoul (KR); Myung-Sam Kang, Hwaseong-si (KR); Kwang-Il Park, Ansan-si (KR); Young-Gwan Ko, Seoul (KR); Youn-Soo Seo, Suwon-si (KR); Woon-Chul Choi, Goyang-si (KR); Hye-Yeon Cha, Yongin-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 62 days.

(21) Appl. No.: 14/951,112

(22) Filed: Nov. 24, 2015

(65) Prior Publication Data

US 2016/0240296 A1 Aug. 18, 2016

(30) Foreign Application Priority Data

Feb. 13, 2015 (KR) ..... 10-2015-0022132

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |
| ***H01F 17/04*** | (2006.01) |
| ***H01F 41/04*** | (2006.01) |
| ***H01F 41/10*** | (2006.01) |

(52) U.S. Cl.

CPC ..... *H01F 27/292* (2013.01); *H01F 17/0013* (2013.01); *H01F 17/04* (2013.01); *H01F 41/042* (2013.01); *H01F 41/10* (2013.01); *H01F 2017/0066* (2013.01); *H01F 2017/048* (2013.01)

(58) Field of Classification Search

CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 6,169,470 | B1 * | 1/2001 | Ibata | H01F 17/0006 336/200 |
| 6,392,525 | B1 * | 5/2002 | Kato | H01F 3/08 336/200 |
| 2002/0053967 | A1 * | 5/2002 | Shikama | H01F 41/04 336/83 |
| 2005/0195062 | A1 * | 9/2005 | Yoshida | H01F 27/2804 336/200 |
| 2006/0152321 | A1 * | 7/2006 | Jung | H01F 17/0006 336/200 |
| 2008/0157910 | A1 * | 7/2008 | Park | H01F 17/0006 336/110 |
| 2013/0033347 | A1 * | 2/2013 | Matsuura | H01F 17/0033 336/83 |
| 2013/0057378 | A1 * | 3/2013 | Wi | H01F 17/0013 336/199 |

(Continued)

FOREIGN PATENT DOCUMENTS

JP 2012138496 A * 7/2012

*Primary Examiner* — Tsz Chan
(74) *Attorney, Agent, or Firm* — NSIP Law

(57) ABSTRACT

A coil electronic component includes: a magnetic body comprising a magnetic material; a coil part embedded inside the magnetic body; and a magnetic layer disposed on a surface of the magnetic body.

9 Claims, 6 Drawing Sheets

(56) References Cited

U.S. PATENT DOCUMENTS

| | | | | |
|---|---|---|---|---|
| 2013/0113593 | A1* | 5/2013 | Jeong | H01F 17/0013 336/200 |
| 2013/0147591 | A1* | 6/2013 | Kim | H01F 17/04 336/200 |
| 2013/0249664 | A1* | 9/2013 | Tonoyama | H01F 41/04 336/200 |

* cited by examiner

COIL ELECTRONIC COMPONENT AND MANUFACTURING METHOD THEREOF

CROSS-REFERENCE TO RELATED APPLICATION(S)

This application claims the benefit of Korean Patent Application No. 10-2015-0022132, filed in the Korean Intellectual Property Office on Feb. 13, 2015, the entire disclosure of which is incorporated herein by reference for all purposes.

BACKGROUND

1. Field

The following description relates to a coil electronic component and manufacturing method thereof.

2. Description of Related Art

An inductor, which is a chip electronic component, is a representative passive element for configuring an electronic circuit together with a resistor and a capacitor for removing noise.

The thin layer inductor is manufactured by forming a coil part by a plating process, forming a magnetic body by hardening a magnetic-resin compound that is a mixture of a magnetic powder and a resin, and forming external contacts on outer surfaces of the magnetic body.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to one general aspect, a coil electronic component includes: a magnetic body comprising a magnetic material; a coil part embedded in the magnetic body; and a magnetic layer disposed on a surface of the magnetic body.

The magnetic layer may include a metallic layer.

The magnetic layer may be formed by a plating process.

The coil electronic component may further include a plating seed layer disposed between the surface of the magnetic body and the magnetic layer.

The coil electronic component may further include an insulating cover layer disposed on the magnetic layer.

The magnetic layer may be formed of a metal or an alloy that includes at least one of iron (Fe), silicon (Si), boron (B), chromium (Cr), aluminum (Al), copper (Cu), niobium (Nb), or nickel (Ni).

The coil part may include a lead part that extends to a portion of the surface of the magnetic body, and the magnetic layer may be disposed only on portions of the surface of the magnetic body other than the portion of the surface of the magnetic body to which the lead part extends.

The magnetic material may include a metallic magnetic powder and a thermosetting resin.

The coil part may be formed by a plating process.

According to another general aspect, a manufacturing method of a coil electronic component includes: forming a coil part; forming a magnetic body by stacking magnetic sheets above and below the coil part, each of the magnetic sheets comprising a metallic magnetic powder and a thermosetting resin; and forming a magnetic layer on a surface of the magnetic body.

The method may further include forming the magnetic layer by a plating process.

The method may further include forming a plating seed layer on the surface of the magnetic body before the forming of the magnetic layer on the surface of the magnetic body.

The method may further include, after the forming of the magnetic layer, removing, by an etching process, a portion of the magnetic layer on a portion of the surface of the magnetic body to which a lead part of the coil part extends.

The method may further include, after the forming of the magnetic layer, forming an insulating cover layer on the magnetic layer.

The magnetic layer may include a metal or an alloy including at least one of iron (Fe), silicon (Si), boron (B), chromium (Cr), aluminum (Al), copper (Cu), niobium (Nb), or nickel (Ni).

According to another general aspect, a coil electronic component includes: a body including first and second end surfaces, first and second side surfaces, and first and second main surfaces, wherein the first and second main surfaces extend between the first and second end surfaces and between the first and second side surfaces; a coil part embedded in the magnetic body and including lead parts extending to the first and second end surfaces; and a magnetic layer disposed only on the first and second side surfaces and the first and second main surfaces.

The coil electronic component may further include external contacts disposed on the first and second end surfaces, and connected to the lead parts.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Chip Electronic Component

Hereinafter, an example of a coil electronic component, particularly, a thin layer inductor, will be described. However, the disclosure is not limited thereto.

Figure 1:
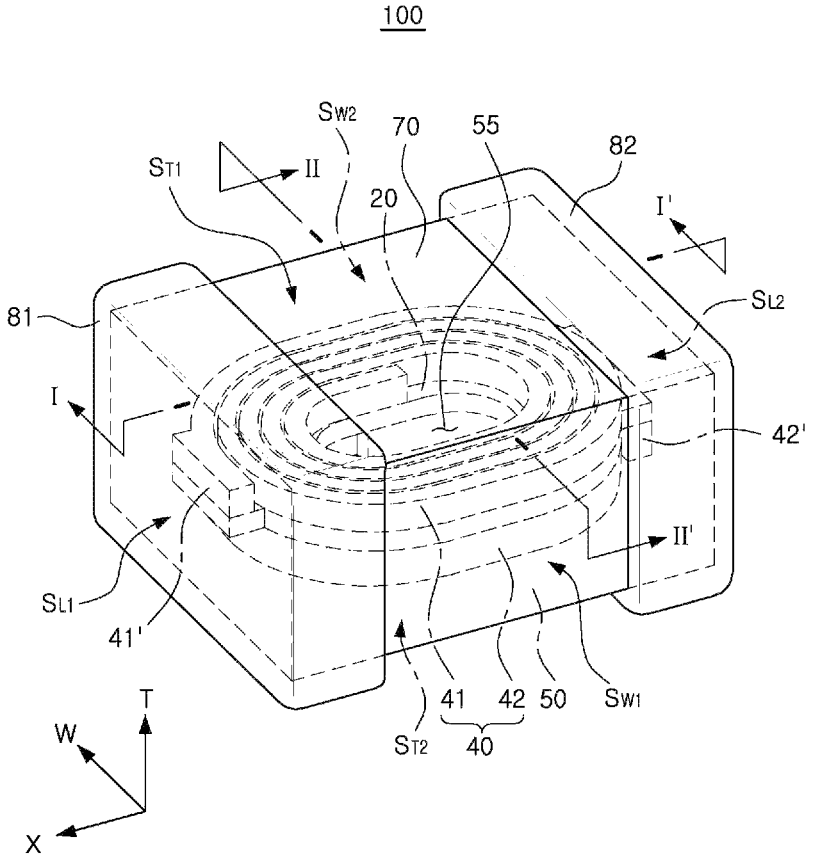
FIG. 1 is a schematic perspective view of a coil part of a chip electronic component according to an example.

FIG. 1 is a schematic perspective view of a coil part of a chip electronic component according to an example.

Referring to FIG. 1, a thin layer power inductor used for a power line of a power supply circuit is illustrated as a coil electronic component 100, by way of example.

The coil electronic component 100 includes include a magnetic body 50, a coil part 40 that is embedded inside of the magnetic body 50, and a first external contact 81 and a second external contact 82 that are arranged on the outer surfaces of the magnetic body 50 and electrically connected to the coil part 40.

In the chip electronic component 100, X, W and T in FIG. 1 respectively refer to a length direction, a width direction, and a thickness direction.

The magnetic body 50 includes first and second end surfaces $S_{L1}$ and $S_{L2}$ that face to each other in the length direction X, first and second side surfaces $S_{W1}$ and $S_{W2}$ that connect the first and second end surfaces $S_{L1}$ and $S_{L2}$ and face to each other in the width direction W, and first and second main surfaces $S_{T1}$ and $S_{T2}$ that face to each other in the thickness direction T. The magnetic body 50 may include any magnetic material that exhibits magnetic properties, for example, a ferrite or a metallic magnetic powder.

The coil part 40 is formed by coupling a first coil conductor 41 that is formed on one surface of a substrate 20 that is arranged inside the magnetic body 50 to a second coil conductor 42 that is formed on another surface that faces the one surface of the substrate 20.

The first and the second coil conductors 41 and 42 may each have a planar coil shape that is formed on the respective surface of the substrate 20. Alternatively, the first coil conductor 41 and the second coil conductor 42 may have a spiral shape. The first and second coil conductors 41 and 42 may be formed, for example, by performing an electroplating process on the substrate, but are not limited to being formed in such a manner.

The substrate 20 may be, for example, a polypropylene glycol (PPG) substrate, a ferrite substrate, a metal based soft magnetic substrate, or the like.

The substrate 20 may have a through hole formed in a central portion thereof, and the through hole may be filled with a magnetic material to from a core part 55 within the magnetic body 50. The core part 55 filled with the magnetic material may increase an inductance L.

A magnetic layer 62 is formed on the coil part 40. The magnetic layer 62 according to an example will be described in detail below.

An insulating cover layer 70 is formed on the magnetic layer 62. By forming the insulating cover layer 70 to cover the magnetic layer 62, a short-circuit defect due to the magnetic layer 62 can be prevented.

Figure 2:
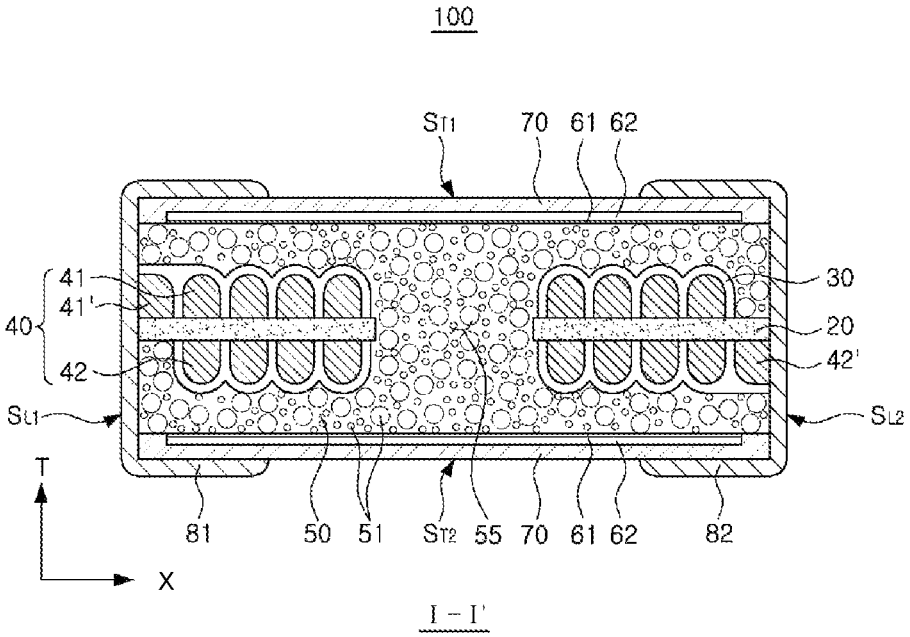
FIG. 2 is a cross-sectional view taken along line I-I' of FIG. 1.

FIG. 2 is a cross-sectional view taken along line I-I' of FIG. 1

Referring to FIG. 2, the magnetic body 50 includes a metallic magnetic powder 51.

The metallic magnetic powder 51 may be a crystalline or amorphous metal or an alloy that includes at least one of iron (Fe), silicon (Si), boron (B), chromium (Cr), aluminum (Al), copper (Cu), niobium (Nb), or nickel (Ni). For example, the metallic magnetic powder 51 may be, but is not limited to, Fe—Si—Cr based amorphous metal.

The metallic magnetic powder 51 may have a particle size of about 0.1 μm to about 30 μm, and may have more than two metallic magnetic powders with different average particle sizes. By mixing two metallic magnetic powders with different average particle sizes, the density may be increased so that high permeability can be secured and a deterioration in efficiency thereof due to core loss can be prevented even under high frequency and high current conditions.

The metallic magnetic powder 51 may be dispersed in a thermosetting resin. The thermosetting resin may be, for example, epoxy resin, polyimide, or the like.

The coil electronic component 100, according to an example, includes the magnetic layer 62 that is formed on the magnetic body 50.

The magnetic layer 62 may be formed of a soft magnetic material with a high permeability and may be, for example, formed of a metal or an alloy that includes at least one of iron (Fe), silicon (Si), boron (B), chromium (Cr), aluminum (Al), copper (Cu), niobium (Nb), or nickel (Ni). Preferably, the magnetic layer 62 may be formed of Fe—Si or Fe—Ni. The magnetic layer 62 may be formed, for example, by performing an electroplating process on the magnetic body 50, but is not limited to being formed by such a process.

The magnetic layer 62 may be formed on the magnetic body 50 to increase the permeability of the coil electronic component 100 and to implement high inductance L and excellent quality factor Q. In addition, since the magnetic layer 62 surrounds surfaces of the magnetic body 50, loss of magnetic flux can be prevented.

As the miniaturization of the coil electronic component has been required along with the gradual miniaturization of the electronic devices, the volume of the magnetic material and the number of turns of the coil part decrease due to the miniaturization of the chip electronic component, thereby deteriorating the inductance and quality factor.

Despite the conventional efforts to solve these problems through improving permeability by forming the magnetic body using a magnetic material having a high permeability, it has been difficult to achieve the target inductance and quality factor while decreasing the size of the chip electronic components due to limitations in developing materials having a high permeability.

However, in the examples disclosed herein, by forming the magnetic layer 62 with high permeability on surfaces of the magnetic body 50, the entire permeability of the coil electronic component 100 may be increased without increasing the permeability of the magnetic material that is included in the magnetic body 50.

The disclosed examples may implement high inductance L without increasing the number of turns of the coil part 40 by forming the magnetic layer 62, increase the permeability of the coil electronic component 100, and reduce the number of coil turns to increase volume of the magnetic material so that the quality factor Q may be increased. In addition, since the magnetic layer 62 surrounds surfaces of the magnetic body 50, loss of magnetic flux can be prevented.

A plating seed layer 61 may be formed between the surfaces of the magnetic body 50 and the magnetic layer 62. The plating seed layer 61 works as a seed for electroplating to form the magnetic layer 62 on the magnetic body 50 and may include a material having excellent electrical conductivity, for example, copper (Cu). The plating seed layer 61 may be formed, for example, by a thin film process such as electroless plating, sputtering, or the like, but is not limited to being formed by such processes.

As discussed above, the insulating cover layer 70 is formed on the magnetic layer 62. The insulating cover layer 70 may include an insulating material such as epoxy resin. By forming the insulating cover layer 70, a short-circuit defect due to the magnetic layer 62 can be prevented, and defects such as plating spread can be also prevented when forming a plating layer of external contacts 81 and 82.

The coil part 40 includes a first lead part 41' that extends from one end portion of the first coil conductor 41 to the first end surface $S_{L1}$ in the length direction X of the magnetic body 50, and a second lead part 42' extends from one end portion of the second coil conductor 42 to the second end surface $S_{L2}$ in the length direction X of the magnetic body 50.

The first and second coil conductors 41 and 42 are surrounded by the insulating layer 30 to prevent the first and second coil conductors 41 and 42 from being contacted directly by the magnetic material (e.g., the magnetic powder 51 dispersed in the thermosetting resin) in the magnetic body 50.

The first and the second external contacts 81 and 82 are respectively arranged on the first and the second end surfaces $S_{L1}$ and $S_{L2}$ in the length direction X of the magnetic body 50, and are respectively connected to the first and the second lead parts 41' and 42'.

Except for the first and second end surfaces $S_{L1}$ and $S_{L2}$ of the magnetic body 50, the magnetic layer 62 may be formed on any surfaces of the magnetic body 50. For example, the magnetic layer 62 may be formed on the first and the second side surfaces $S_{W1}$ and $S_{W2}$ in the width direction W and the first and the second main surfaces $S_{T1}$ and $S_{T2}$ in the thickness direction T.

By not forming the magnetic layer 62 on the end surfaces $S_{L1}$ and $S_{L2}$ of the magnetic body 50, a short-circuit defect can be prevented. In addition, the magnetic layer 62 is covered by the insulating cover layer 70 to prevent direct contact with the first and the second external contacts 81 and 82.

Figure 3:
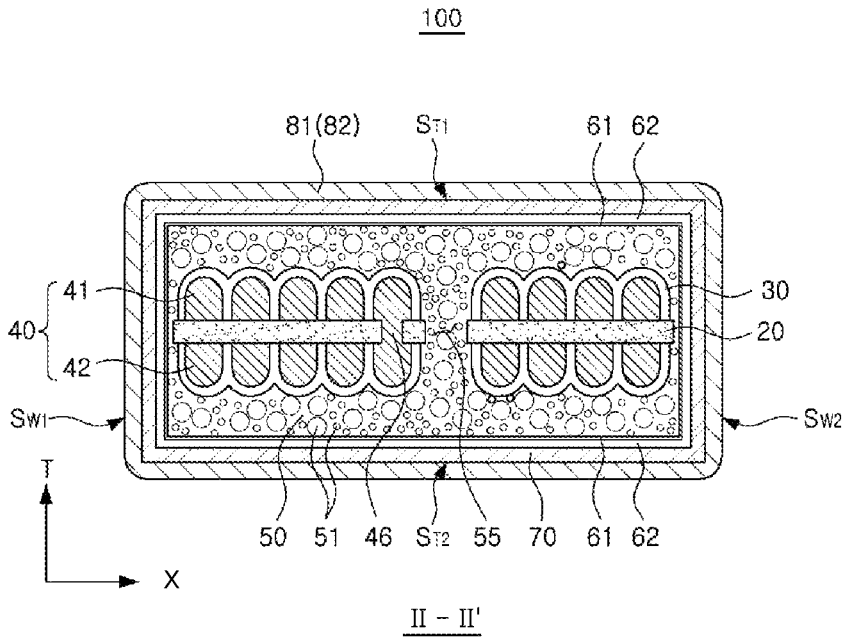
FIG. 3 is a cross-sectional view taken along line II-II' of FIG. 1.

FIG. 3 is a cross-sectional view taken along line II-II' of FIG. 1

Referring to FIG.3, the first and the second coil conductors 41 and 42 are connected through a via 46 that penetrates through the substrate 20. The first and the second coil conductors 41 and 42 and the via 46 may be formed, for example, of a metal having excellent electrical conductivity, such as silver (Ag), palladium (Pd), aluminum (Al), nickel (Ni), titanium (Ti), gold (Au), copper (Cu), platinum (Pt) or an alloy thereof.

The first coil conductor 41 and the second coil conductor 42 are coated with the insulating layer 30 to prevent direct contact with the magnetic material of the magnetic body 50 and to prevent a short-circuit defect.

Manufacturing Method of Chip Electronic Component

FIGS. 4 through 9 are views schematically describing an example manufacturing method of the chip electronic component 100.

Figure 4:
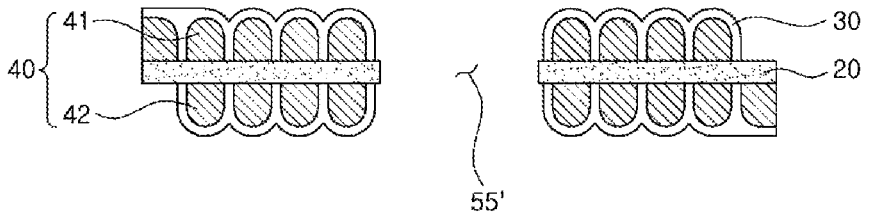
FIGS. 4 through 9 are views schematically describing an example of a manufacturing method of the coil electronic component.

Referring to FIG. 4, the coil part 40 is formed.

After a via hole (not shown) is formed in the substrate 20 and a plating resist (not shown) having an opening is formed on the substrate 20, the first and the second coil conductors 41 and 42 and the via 46 that connects the first and the second coil conductors 41 and 42 may be formed by filling the via hole and the opening with a conductive metal by a plating process.

The first and the second coil conductors 41 and 42 and the via 46 may be formed, for example, of a metal having excellent electrical conductivity, such as silver (Ag), palladium (Pd), aluminum (Al), nickel (Ni), titanium (Ti), gold (Au), copper (Cu), platinum (Pt) or an alloy thereof.

The method of forming the coil part 40 is not limited to the aforementioned plating process. The coil part 40 may, for example, be formed with a metallic wire or have any suitable shapes that can be formed inside of the magnetic body 50 and generate a magnetic flux by a current that is applied thereto.

The insulating layer 30 is formed on the first and the second coil conductors 41 and 42 to coat the first and the second coil conductors 41 and 42.

The insulating layer 30 may be formed, for example, by a known method such as a screen printing method, an exposure and development method of a photoresist (PR), a spraying method, an oxidation method by chemical etching of coil conductor, or the like.

A core hole 55' may be formed by removing the central portion of the substrate 20, in which the first and the second coil conductors 41 and 42 are not formed. The removal of the central portion of the substrate 20 may be performed by mechanical drilling, laser drilling, sand blasting, punching, or the like.

Figure 5:
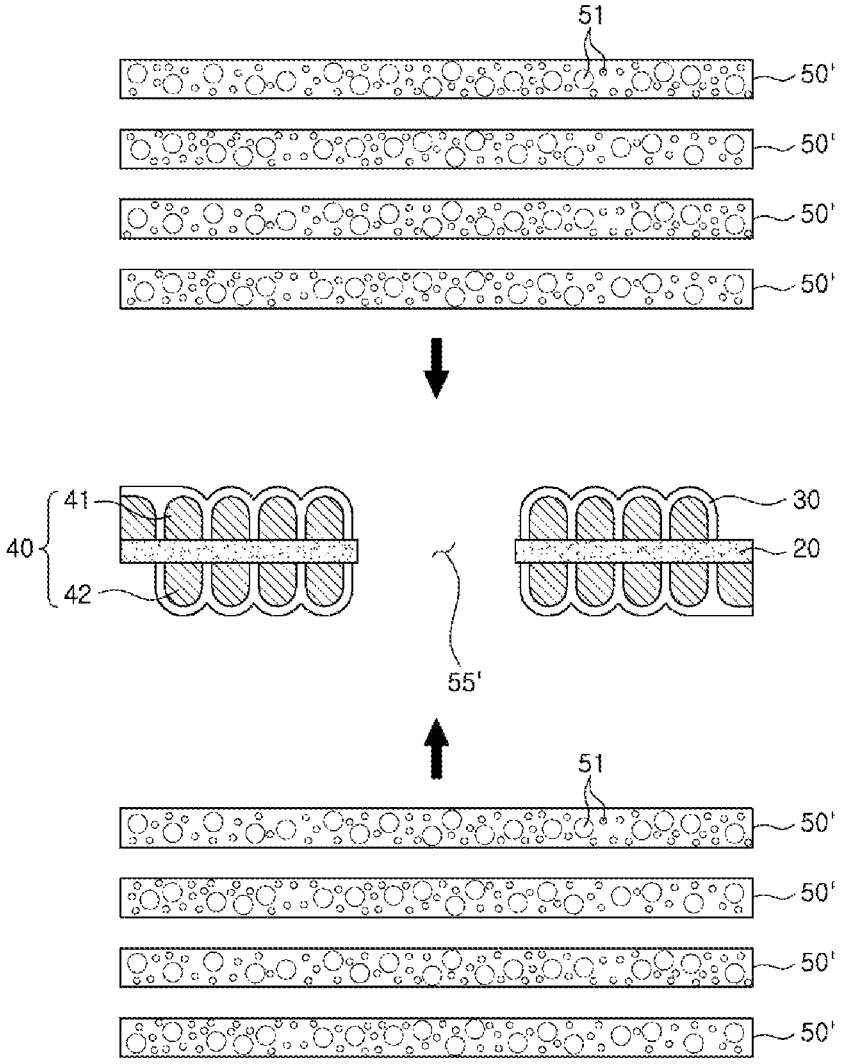

Referring to FIG. 5, magnetic sheets 50' containing the metallic magnetic powder 51 are manufactured.

The magnetic sheets 50' may be manufactured in a sheet shape by mixing the metallic magnetic powder 51, a thermosetting resin, a binder, and a solvent to manufacture a slurry, applying the slurry to a carrier film to a thickness of several tens of μm by using a doctor blade, and then drying the applied slurry.

The magnetic sheets 50' contain the metallic magnetic powder 51 dispersed in the thermosetting resin such as epoxy resin, polyimide, or the like.

The magnetic body 50 in which the coil part 40 is embedded is formed by stacking the magnetic sheets 50' above and below the first and second coil conductors 41 and 42, and then compressing and hardening the magnetic sheets 50'.

Thereafter, the core hole 55' is filled with the magnetic material to form the core part 55.

The method of forming the magnetic body 50 in which the coil part 40 is embedded is not be limited the aforementioned process, and any suitable method that is capable of forming a magnetic-resin compound in which the coil part 40 is embedded may be applied.

Figure 6:
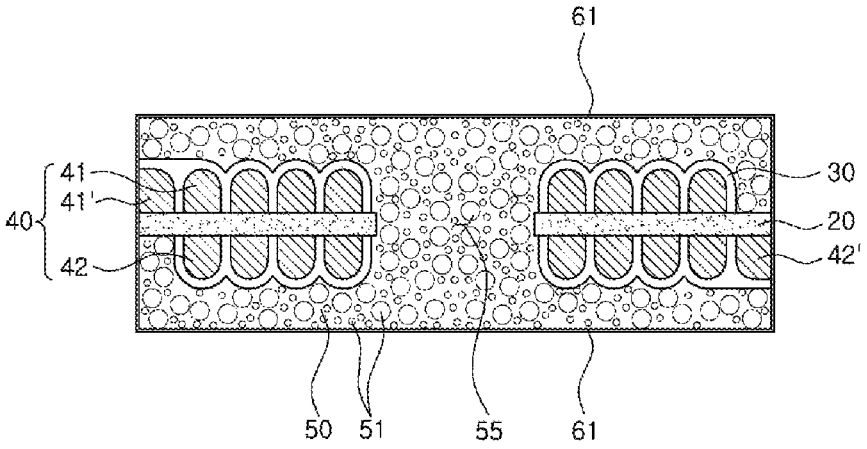

Referring to FIG. 6, the plating seed layer 61 is formed on the surfaces of the magnetic body 50.

The plating seed layer 61 functions as a seed for electroplating to form the magnetic layer 62 on the magnetic body 50 and may include a material having excellent electrical conductivity, for example, copper (Cu). The plating seed layer 61 may be formed, by a thin film process such as electroless plating, sputtering, or the like, but is not limited to such processes.

Figure 7:
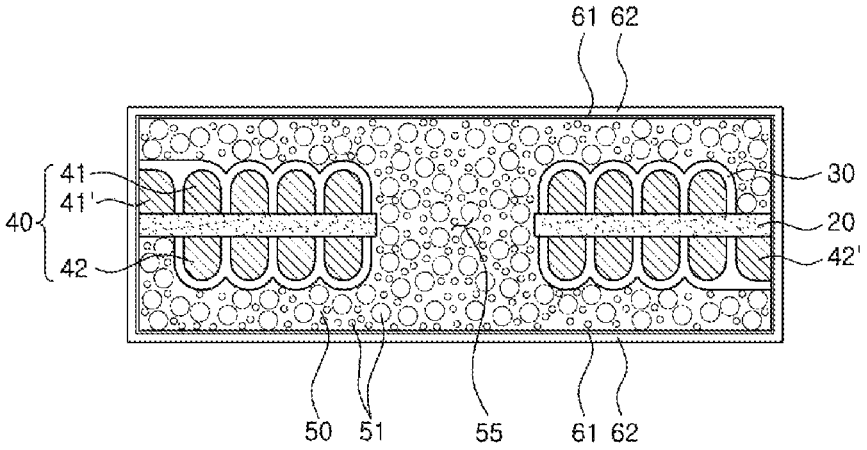

Referring to FIG. 7, the magnetic layer 62 is formed on the plating seed layer 61.

The magnetic layer 62 may be formed of a soft magnetic material with a high permeability and may be, for example, formed of a metal or an alloy that includes at least one of iron (Fe), silicon (Si), boron (B), chromium (Cr), aluminum (Al), niobium (Nb), or nickel (Ni). The magnetic layer 62 may be formed, for example, by performing an electroplating process on the magnetic body 50, but is not limited to being formed by such a process.

The magnetic layer 62 is formed on the magnetic body 50 to increase the permeability of the coil electronic component 100 and to implement high inductance L and excellent quality factor Q. In addition, since the magnetic layer 62 surrounds surfaces of the magnetic body 50, loss of magnetic flux can be prevented.

Figure 8:
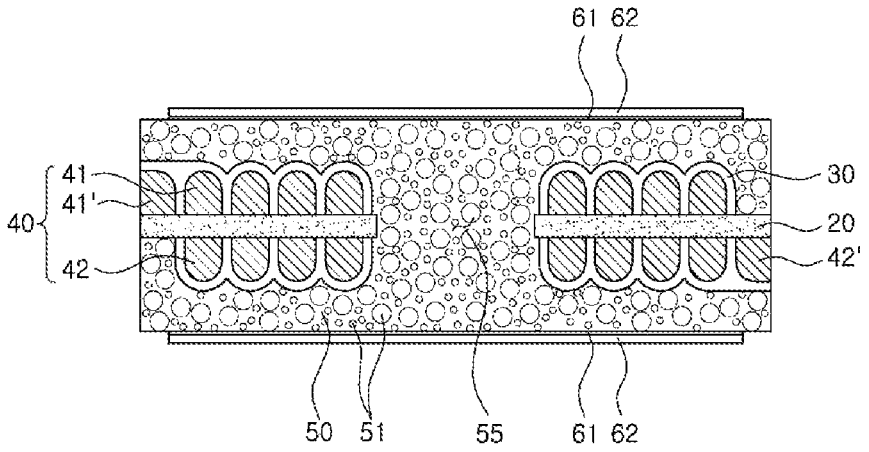

Referring to FIG. 8, portions of the plating seed layer 61 and the magnetic layer 62 that are formed on the end surfaces of the magnetic body 50, to which the lead parts 41' and 42' of the coil part 40 extend, are removed. These portions of the plating seed layer 61 and the magnetic layer 62 may be removed, for example, by a chemical etching process. However, these portions of the plating seed layer 61 and the magnetic layer 62 may be removed by other processes.

By removing the portions of plating seed layer 61 and the magnetic layer 62 that are formed on the end surfaces of the magnetic body 50, a short-circuit defect can be prevented.

Figure 9:
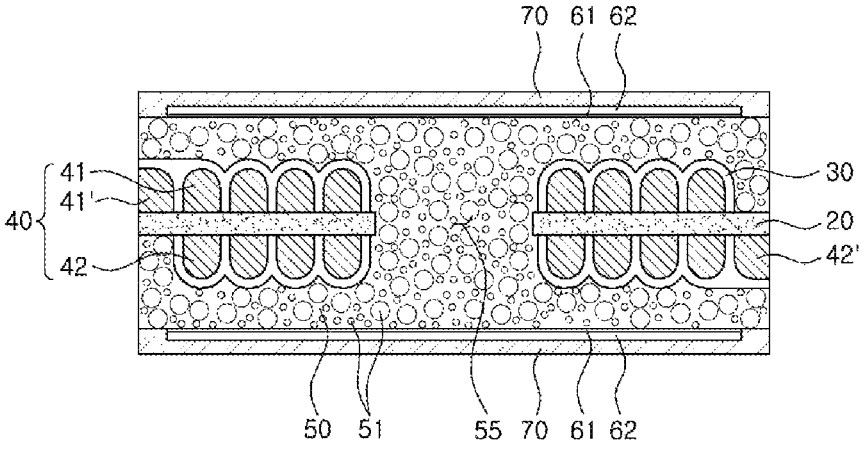

Referring to FIG. 9, the insulating cover layer 70 is formed on the magnetic layer 62. The insulating cover layer 70 may include an insulating material such as epoxy resin. By forming the insulating cover layer 70, a short-circuit defect due to the magnetic layer 62 can be prevented, and defects such as plating spread can be also prevented when forming a plating layer of external contacts 81 and 82 (FIG. 2).

The first and the second external contacts 81 and 82 (FIG. 2) are formed on the outer surfaces of the magnetic body 50 and are electrically connected to the lead parts 41' and 42' of the coil part 40.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil electronic component, comprising:

a magnetic body comprising a magnetic material;

a coil part embedded in the magnetic body;

a plating seed layer disposed on a surface of the magnetic body; and a metal plating of magnetic material different from the magnetic body and disposed on a surface of the plating seed layer, wherein the plating seed layer is disposed between the magnetic body and the metal plating to abut the magnetic body and the metal plating, and wherein the metal plating is formed of a soft magnetic material.

2. The coil electronic component of claim 1, wherein the metal plating is formed of a metal or metal alloy.

3. The coil electronic component of claim 1, further comprising an insulating cover layer disposed on the metal plating.

4. The coil electronic component of claim 1, wherein the metal plating is formed of a metal or an alloy that includes at least one of iron (Fe), silicon (Si), boron (B), chromium (Cr), aluminum (Al), copper (Cu), niobium (Nb), or nickel (Ni).

5. The coil electronic component of claim 1, wherein:

the coil part comprises a lead part that extends to a portion of the surface of the magnetic body; and the metal plating is disposed only on portions of the surface of the magnetic body other than the portion of the surface of the magnetic body to which the lead part extends.

6. The coil electronic component of claim 1, wherein the magnetic material comprises a metallic magnetic powder and a thermosetting resin.

7. The coil electronic component of claim 1, wherein the coil part is formed of metal plating of conductive material.

8. A coil electronic component, comprising:

a magnetic body of magnetic material comprising first and second end surfaces, first and second side surfaces, and first and second main surfaces, wherein the first and second main surfaces extend between the first and second end surfaces and between the first and second side surfaces;

a coil part embedded in the magnetic body and comprising lead parts extending to the first and second end surfaces;

a plating seed layer disposed only on the first and second side surfaces and the first and second main surfaces; and a metal plating of magnetic material different from the magnetic body and disposed on a surface of the plating seed layer.

9. The electronic coil component of claim 8, further comprising external contacts disposed on the first and second end surfaces, and connected to the lead parts.

* * * * *